US006043020A

United States Patent [19]

Ohtani

[11] Patent Number: 6,043,020

[45] **Date of Patent: *Mar. 28, 2000**

[54] SILVER HALIDE COLOR PHOTOGRAPHIC MATERIAL

[75] Inventor: Shigeaki Ohtani, Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/884,268

[22] Filed: Jun. 27, 1997

[30] Foreign Application Priority Data

Jun. 28, 1996 [JP] Japan ..... 8-168935

[51] Int. Cl.[7] ..... G03C 1/09

[52] U.S. Cl. ..... 430/605; 430/363; 430/534; 430/604

[58] Field of Search ..... 430/605, 604, 430/534

[56] References Cited

U.S. PATENT DOCUMENTS

| | | | |
|---|---|---|---|
| 5,047,316 | 9/1991 | Hirano et al. | 430/545 |
| 5,462,843 | 10/1995 | Klotzer et al. | 430/605 |
| 5,462,849 | 10/1995 | Kuromoto et al. | 430/605 |
| 5,496,689 | 3/1996 | Ogawa | 430/605 |
| 5,508,156 | 4/1996 | Kawai | 430/605 |
| 5,561,039 | 10/1996 | Ochiai | 430/605 |
| 5,593,820 | 1/1997 | Sluirai | 430/605 |
| 5,672,468 | 9/1997 | Okazaki | 430/605 |

FOREIGN PATENT DOCUMENTS

| | | |
|---|---|---|
| 0 294 104 | 12/1988 | European Pat. Off. . |
| 3-158847 | 7/1991 | Japan . |

*Primary Examiner*—Hoa Van Le
*Attorney, Agent, or Firm*—Sughrue, Mion, Zinn Macpeak & Seas, PLLC

[57] ABSTRACT

A silver halide color photographic material is disclosed which comprises a support having provided thereon at least one silver halide emulsion layer containing a yellow dye-forming coupler, at least one silver halide emulsion layer containing a magenta dye-forming coupler, and at least one silver halide emulsion layer containing a cyan-dye forming coupler, wherein at least one of said at least one emulsion layers (i) contains silver chloride or silver chlorobromide emulsion grains having a silver chloride content of 95 mol % or more and substantially free of silver iodide, and (ii) has a ratio of point gamma I to point gamma II of 0.7 to 1.3, wherein when points giving densities of 1.0 and 1.5 on a characteristic curve obtained by an exposure time of $10^{-4}$ second are joined by a straight line, point gamma I is a point gamma on the characteristic curve, at a density which is 1.5 or more and which satisfies the condition where the value of logE on the characteristic curve is larger by 0.05 than that on the straight line at the same density, and wherein when points giving densities of 1.0 and 1.5 on a characteristic curve obtained by an exposure time of 0.1 second are joined by a straight line, point gamma II is a point gamma on the characteristic curve, at a density which is 1.5 or more and which satisfies the condition where the value of logE on the characteristic curve is larger by 0.05 than that on the straight line at the same density.

31 Claims, No Drawings

SILVER HALIDE COLOR PHOTOGRAPHIC MATERIAL

FIELD OF THE INVENTION

The present invention relates to a silver halide color photographic material and, particularly, to a silver halide color photographic material which is excellent in imaging letters in the image formed by both exposure systems of surface exposure and scanning exposure.

BACKGROUND OF THE INVENTION

It has become comparatively easy for the image read by a scanner to be image-processed by a computer owing to the advancement of the computer technique in the last few years. Further, it has been discussed to use a silver halide photographic material for responding to a demand for the increase in high picture quality of the hard copy of an image, and image formation by a scanning exposure system has been conducted.

As is seen in recent years, for example, in post cards made by Fuji Photo Film Co., Ltd., a demand for obtaining a photographic image and letters on the same print has increased. Further, as the synthesis of an image with letters has become easy due to the advancement of the computer technique as described above, a demand for outputting it as a hard copy goes on increasing.

As an image formation system by known scanning exposure system, a method of applying scanning exposure using a light emitting diode as a light source to a photographic material has been disclosed in JP-B-62-21305 (the term "JP-B" as used herein means an "examined Japanese patent publication"). A method of scanning exposure of a high silver chloride content photographic material by a laser beam is disclosed in JP-A-62-35352 (the term "JP-A" as used herein means an "unexamined published Japanese patent application"). A method of scanning exposure using a second harmonic obtained by a semiconductor laser and an SHG element as a light source is disclosed in JP-A-63-18346. Further, the reduction of a total image formation time has been achieved using high silver chloride content silver halide in a photographic material as disclosed in WO 87/04534.

The present inventors have outputted the image plane of an image coexisting with letters on a color photographic paper by scanning exposure based upon these methods disclosed in the above patents, but it was found that if the density of black letters is made to coincide with that of surface exposure, a problem arose such that the periphery of letters blurred and imaging capability of letters was inferior.

SUMMARY OF THE INVENTION

Accordingly, an object of the present invention is to provide a silver halide color photographic material which is excellent in imaging letters in the image formed by both exposure systems of surface exposure and scanning exposure.

As a result of eager examination by the present inventors, the above object of the present invention has been effectively attained by a silver halide color photographic material described in the following (1) to (4). That is:

(1) A silver halide color photographic material which comprises a support having provided thereon at least one silver halide emulsion layer containing a yellow dye-forming coupler, at least one silver halide emulsion layer containing a magenta dye-forming coupler, and at least one silver halide emulsion layer containing a cyan-dye forming coupler, wherein at least one said emulsion layer contains silver chloride or silver chlorobromide emulsion grains having a silver chloride content of 95 mol % or more and substantially free of silver iodide, and wherein at least one said emulsion layer has a ratio of point gamma I to point gamma II of 0.7 to 1.3, wherein when points giving fog 1.0 and fog 1.5 on a characteristic curve I (D-logE curve, where D represents a density and E represents an exposure amount) obtained by the exposure time of $10^{-4}$ second are joined by a straight line, point gamma I is a point gamma on the characteristic curve I, at a density which is 1.5 or more and which satisfies the condition where the value of logE on the characteristic curve I is larger than by 0.05 than that on the straight line at the same density, wherein when points giving fog 1.0 and fog 1.5 on a characteristic curve II obtained by the exposure time of 0.1 second are joined by a straight line, point gamma II is a point gamma on the characteristic curve II, at a density which is 1.5 or more and which satisfies the condition where the value of logE on the characteristic curve II is larger than by 0.05 than that on the straight line at the same density.

(2) The silver halide color photographic material as described in (1), wherein the ratio of (i) the reflection density at a wavelength having a maximum intensity of a coherent light for sensitizing the silver halide emulsion in the silver halide emulsion layer containing a magenta dye-forming coupler, to (ii) the reflection density of the photographic material at 550 nm is 0.6 or more.

(3) The silver halide color photographic material as described in (1) or (2), wherein all of said silver halide emulsion layer containing a yellow dye-forming coupler, said silver halide emulsion layer containing a magenta dye-forming coupler, and said silver halide emulsion layer containing a cyan-dye forming coupler contain silver chloride or silver chlorobromide emulsion grains having a silver chloride content of 95 mol % or more and substantially free of silver iodide.

(4) The silver halide color photographic material as described in (2) or (3), wherein the ratio of (i) the reflection density at a wavelength having a maximum intensity of a coherent light for sensitizing the silver halide emulsion in the silver halide emulsion layer containing a cyan dye-forming coupler, to (ii) the reflection density of the photographic material at 700 nm is from 0.6 to 1.4, and the ratio of (i) the reflection density at a wavelength having a maximum intensity of a coherent light for sensitizing the silver halide emulsion in the silver halide emulsion layer containing a yellow dye-forming coupler is sensitized, to (ii) the reflection density of the photographic material at 480 nm is from 0.6 to 1.4.

DETAILED DESCRIPTION OF THE INVENTION

The specific constitution of the present invention is described in detail below.

The characteristic curve in the present invention is a so-called D-logE curve in which logE (E is the exposure amount) on the axis of abscissa and D (density) on the axis of ordinate are plotted. The characteristic curve is described in detail, for example, in T.H. James, *The Theory of the Photographic Process,* 4th Ed., pages 501 to 509.

Point gamma can be obtained by the following equation as defined on page 502 of the above literature:

$$\text{Point Gamma} = dD/d\log E$$

and it represents a differentiated value on an arbitrary point on the characteristic curve, and the meaning of which is described in *R. Lutter. Trans. Faraday Soc.,* Vol. 19, page 340 (1923).

The characteristic curve for use in the present invention is obtained as follows. In the first place, samples are subjected to gradation exposure for sensitometry through blue, green and red filters for exposure time of 0.1 second and $10^{-4}$ second respectively using an FW type sensitometer produced by Fuji Photo Film Co., Ltd. and an HIE type sensitometer produced by Yamashita Denso K.K.

Subsequently, the samples are development processed as described below, and after processing the reflection densities of the samples are measured through blue, green and red filters using an HSD type automatic densitometer produced by Fuji Photo Film Co., Ltd. The thus-obtained data logE (E is the exposure amount) as the axis of abscissa and D (density) as the axis of ordinate are plotted and the characteristic curve is obtained.

| Step | Processing Temperature (° C.) | Processing Time (sec) | Replenishment Rate* (ml) | Tank Capacity (liter) |
|---|---|---|---|---|
| Color Development | 35 | 45 | 161 | 10 |
| Blixing | 35 | 45 | 218 | 10 |
| Rinsing (1) | 35 | 30 | — | 5 |
| Rinsing (2) | 35 | 30 | — | 5 |
| Rinsing (3) | 35 | 30 | 360 | 5 |
| Drying | 80 | 60 | | |

*Replenishing rate per $m^2$ of the photographic material
Rinsing was conducted in a 3-tank countercurrent system from rinsing (3) to rinsing (1).

| Color Developing Solution | Tank Solution | Replenisher |
|---|---|---|
| Water | 800 ml | 800 ml |
| Ethylenediaminetetraacetic Acid | 3.0 g | 3.0 g |
| Disodium 4,5-dihydroxybenzene-1,3-disulfonate | 0.5 g | 0.5 g |
| Triethanolamine | 12.0 g | 12.0 g |
| Potassium Chloride | 2.5 g | — |
| Potassium Bromide | 0.01 g | — |
| Potassium Carbonate | 27.0 g | 27.0 g |
| Brightening Agent (WHITEX 4, manufactured by Sumitomo Chemical Co., Ltd.) | 1.0 g | 2.5 g |
| Sodium Sulfite | 0.1 g | 0.2 g |
| Disodium-N,N-bis(sulfonato-ethyl)hydroxylamine | 5.0 g | 8.0 g |
| N-Ethyl-N-(β-methanesulfon-amidoethyl)-3-methyl-4-aminoaniline.3/2 Sulfate. Monohydrate | 5.0 g | 7.1 g |
| Water to make | 1,000 ml | 1,000 ml |
| pH (25° C., adjusted with potassium hydroxide and sulfuric acid) | 10.05 | 10.45 |

Blixing Solution (the tank solution and the replenisher are the same)

| | |
|---|---|
| Water | 600 ml |
| Ammonium Thiosulfate (700 g/liter) | 100 ml |
| Ammonium Sulfite | 40 g |
| Ammonium Ethylenediaminetetraacetato Ferrate | 55 g |
| Disodium ethylenediaminetetraacetate | 5 g |
| Ammonium Bromide | 40 g |
| Sulfuric Acid (67%) | 30 g |
| Water to make | 1,000 ml |
| pH (25° C., adjusted with acetic acid and aqueous ammonia) | 5.8 |

-continued

Rinsing Solution (the tank solution and the replenisher are the same)

| | |
|---|---|
| Sodium Chlorinated Isocyanurate | 0.02 g |
| Deionized water (electric conductivity: 5 μs/cm or less) | 1,000 ml |
| pH | 6.5 |

In the present invention, a silver halide color photographic material comprises a support having provided thereon at least one silver halide emulsion layer containing a yellow dye-forming coupler, at least one silver halide emulsion layer containing a magenta dye-forming coupler, and at least one silver halide emulsion layer containing a cyan-dye forming coupler, wherein at least one said emulsion layer has a ratio of point gamma I to point gamma II of 0.7 to 1.3, preferably 0.8 to 1.2, more preferably 0.9 to 1.1, wherein when points giving fog 1.0 and fog 1.5 on a characteristic curve I (D-logE curve, where D represents a density and E represents an exposure amount) obtained by the exposure time of $10^{-4}$ second are joined by a straight line, point gamma I is a point gamma on the characteristic curve I, at a density which is 1.5 or more and which satisfies the condition where the value of logE on the characteristic curve I is larger than by 0.05 than that on the straight line at the same density, wherein when points giving fog 1.0 and fog 1.5 on a characteristic curve II obtained by the exposure time of 0.1 second are joined by a straight line, point gamma II is a point gamma on the characteristic curve II, at a density which is 1.5 or more and which satisfies the condition where the value of logE on the characteristic curve II is larger than by 0.05 than that on the straight line at the same density.

Further, in the present invention, a silver halide color photographic material comprises a support having provided thereon at least one silver halide emulsion layer containing a yellow dye-forming coupler, at least one silver halide emulsion layer containing a magenta dye-forming coupler, and at least one silver halide emulsion layer containing a cyan-dye forming coupler, wherein all of said emulsion layers preferably have a ratio of point gamma I (defined above) to point gamma II (defined above) of 0.7 to 1.3.

Preferred embodiments of the present invention for practically obtaining the above-described photographic capabilities are described below.

In the present invention, silver chloride or silver chlorobromide having a silver chloride content of 95 mol % or more and substantially free of silver iodide is preferably used as silver halide emulsion for use in a light-sensitive emulsion layer. The terminology "substantially free of silver iodide" as used herein means that the silver iodide content is 1 mol % or less, preferably 0.2 mol % or less. A silver chloride content is more preferably 98 mol % or more.

For silver halide grains according to the present invention, it is particularly important to use ions or complex ions of metals belonging to group VIII of the Periodic Table, that is, osmium, iridium, rhodium, platinum, ruthenium, palladium, cobalt, nickel and iron, alone or in combination. Further, these metals are preferred to be used in combination of two or more. These metals are preferably used in an amount of from $10^{-9}$ to $10^{-2}$ mol per mol of the silver halide. These metal ions are described in more detail blow, but the present invention is not limited to them.

Iridium ion-containing compounds are preferred above all, and trivalent or tetravalent salts or complex salts, in particular, complex salts, are preferred. For example, halogen, amines and oxalato complex salts, e.g., iridous chloride, iridous bromide, iridic chloride, sodium hexachloroiridate(III), potassium hexachloroiridate(IV), hexaammineiridate(IV), trioxalatoiridate(III), trioxalatoiridate(IV), etc., are preferred. Platinum ion-containing compounds are divalent or tetravalent salts or complex salts, and complex salts are preferred. For example, platinic chloride, potassium hexachloroplatinate(IV), tetrachloroplatinous acid, tetrabromoplatinous acid, sodium tetrakis(thiocyanato)platinate(IV), and hexaammineplatinic chloride are used.

Palladium ion-containing compounds are, in general, divalent or tetravalent salts or complex salts, and complex salts are particularly preferred. For example, sodium tetrachloropalladate(II), sodium tetrachloropalladate(IV), potassium hexachloropalladate(IV), tetraamminepalladous chloride, potassium tetracyanopalladate(II), etc., are used. As nickel ion-containing compounds, for example, nickel chloride, nickel bromide, potassium tetrachloronickelate(II), hexaamminenickelous chloride, sodium tetracyanonickelate (II), etc., are used.

Rhodium ion-containing compounds are, in general, trivalent salts or complex salts. For example, potassium hexachlororhodate, sodium hexabromorhodate, ammonium hexachlororhodate, etc., are used. Iron ion-containing compounds are, in general, divalent or trivalent iron ion-containing compounds, and preferably iron salts or iron complex salts having water solubility within the range of concentration used. Particularly preferred are iron complex salts which are easily included in silver halide grains. Examples thereof include ferrous chloride, ferric chloride, ferrous hydroxide, ferric hydroxide, ferrous thiocyanide, ferric thiocyanide, hexacyanoferrate(II) complex salt, hexacyanoferrate(III) complex salt, ferrous thiocyanate complex salt, ferric thiocyanate complex salt, etc. In addition to the above, the metal complexes having six ligands containing at least four cyan ligands disclosed in EP-A-336426 are also preferably used.

These above-described metal ion donating compounds can be included in silver halide grains according to the present invention by various means such as addition to an aqueous solution of gelatin as a dispersion medium, an aqueous solution of halide, an aqueous solution of silver salt, or other aqueous solutions, at silver halide grain formation, or in the form of silver halide fine grains having incorporated therein metal ions in advance and fine grains are dissolved. Metal ions for use in the present invention can be added to silver halide grains at any time before grain formation, during grain formation, or immediately after grain formation. The time of addition can be varied according to the portion of the grains to which the metal ions are incorporated.

Of the above metal ions, iridium ions and iron ions are particularly preferably used. The addition amount of iridium ions is preferably from $1\times10^{-8}$ to $1\times10^{-4}$, more preferably from $1\times10^{-7}$ to $1\times10^{-3}$, per mol of the silver, and the addition amount of iron ions is preferably from $1\times10^{-7}$ to $1\times10^{-3}$, more preferably from $1\times10^{-6}$ to $1\times10^{31\ 4}$, per mol of the silver.

It is particularly preferred that 50 mol % or more of the total content of the above-described metals belonging to group VIII of the Periodic Table be contained in the surface layers which occupy 45% or less, more preferably 30% or less, of the silver halide grain volume. This is especially important with a view to contriving the photographic material to fall within the range of the ratio of the point gamma according to the present invention.

The production process of the silver halide emulsion for use in the present invention comprises, as is generally known, a silver halide grain formation process by the reaction of water-soluble silver salt and water-soluble halide, a desalting process and a chemical ripening process. A silver halide grain for use in the present invention preferably has a silver bromide rich phase. Of the above processes, a silver bromide rich phase is preferably provided before a chemical ripening process, more preferably before a desalting process, and particularly preferably after a grain formation process succeedingly. It is preferred for a silver bromide rich phase to contain metal complex ions such as $IrCl_6^{2-}$. Further, when an iridium compound is contained in a silver bromide rich phase of a silver halide emulsion grain, the silver bromide rich phase is preferably deposited with at least 50 mol % of the entire iridium which are added when silver halide grains are prepared, more preferably with at least 80 mol %, and most preferably the silver bromide rich phase is deposited with the entirety of the iridium added. Herein, the terminology "the rich phase is deposited with the iridium" means that the iridium compound is supplied simultaneously with, immediately before, or immediately after the supply of the silver or halide for forming the rich phase. When the silver bromide rich phase is formed by mixing silver halide fine grains having a smaller average grain size and a higher silver bromide content than those of the silver halide host grains, then ripening, it is preferred that the iridium salt be added in advance to the silver halide fine grains having a higher silver bromide content.

As silver halide grains for use in the present invention, either grains having {111} faces or {100} faces as grain surfaces, grains having both of these faces, or grains having higher faces can be used but cubic or tetradecahedral grains mainly comprising {100} faces are preferably used. The grain size of the silver halide grains for use in the present invention should be sufficient to be within the range generally used, but the average grain size of from 0.1 $\mu$m to 1.5 $\mu$m is preferred. The grain size distribution may be either monodisperse or polydisperse but monodisperse is preferred. Variation coefficient of grain sizes which shows the degree of monodispersibility is defined as the ratio of statistical standard deviation (s) to average grain size (d) (s/d) and 0.2 or less is preferred, 0.15 or less is more preferred. Two or more monodisperse emulsions are also preferably used in admixture.

The silver halide grains contained in the photographic emulsion may have a regular crystal form, such as cubic, tetradecahedral, or octahedral, an irregular crystal form, such as spherical, plate-like, or a composite form of these forms. A mixture of grains having various crystal forms may also be used. In the present invention, the grains having the above described regular crystal forms preferably occupy 50 wt % or more, preferably 70 wt % or more, more preferably 90 wt % or more.

In addition to the above, an emulsion in which the proportion of tabular grains having an average aspect ratio (equivalent-circle diameter/thickness) of 5 or more, preferably 8 or more, to the entire grains is 50 wt % or more as a projected area can also be preferably used. The silver chlorobromide emulsion for use in the present invention can be prepared according to the methods disclosed, for example, in P. Glafkides, *Chimie et Physique Photographigue,* Paul Montel (1967), G. F. Duffin, *Photographic Emulsion Chemistry,* Focal Press (1966), V. L. Zelikman, et al., *Making and Coating Photographic Emulsion,* Focal Press (1964), and so on. That is, any process, such as an acid process, a neutral process, and an ammoniacal process, can be used. A single jet method, a double jet method, and a combination of them are known as methods for reacting a soluble silver salt with a soluble halide, and any of these methods can be used. A method in which silver halide grains are formed in the atmosphere of excessive silver ions (a so-called reverse mixing method) can also be used. Further, a so-called controlled double jet method, which is one form of a double jet method, in which the pAg of the liquid phase in which the silver halide is formed is maintained constant, can also be used. According to this method, a silver halide emulsion having a regular crystal form and substantially an almost uniform grain size can be obtained.

In addition to metals belonging to group VIII, various kinds of polyvalent metal ion impurities can be introduced into the silver halide emulsion for use in the present invention during emulsion grain formation or physical ripening process. Salts or complex salts of cadmium, zinc, lead, copper, thallium, etc., can be used in combination. The addition amount of these compounds varies in a wide range according to end use purposes, but is preferably from $10^{-9}$ to $10^{-2}$ mol per mol of the silver halide.

The silver halide emulsions for use in the present invention are generally subjected to chemical sensitization and spectral sensitization. Chemical sensitization can be performed by effecting sulfur sensitization represented by the addition of an unstable sulfur compound, noble metal sensitization represented by gold sensitization, or reduction sensitization, alone or in combination. Compounds preferably used in chemical sensitization are disclosed in JP-A-62-215272, from page 18, right lower column to page 22, right upper column.

The silver halide emulsions for use in the present invention are preferably emulsions which are subjected to gold sensitization known in the industry. By effecting gold sensitization, the fluctuation in photographic capabilities at the time when scanning exposure by a laser beam, etc., is conducted can be reduced to a smaller degree.

Compounds such as chloroauric acid or salts thereof, gold thiocyanates or gold thiosulfates can be used for gold sensitization. The addition amount of these compounds can be varied in a wide range depending on cases but is generally from $5\times10^{-7}$ to $5\times10^{-3}$ mol. preferably from $1\times10^{-6}$ to $1\times10^{-4}$ mol, per mol of the silver halide. These compounds are added until the termination of chemical sensitization.

In the present invention, gold sensitization is preferably conducted in combination with other sensitization methods such as sulfur sensitization, selenium sensitization, tellurium sensitization, reduction sensitization or noble metal sensitization using noble metals other than gold.

In the present invention, the ratio of the reflection density at a wavelength having a maximum intensity of the coherent light for sensitizing the silver halide emulsion in the silver halide emulsion layer containing a magenta dye-forming coupler, to the reflection density of the photographic material at 550 nm is preferably from 0.6 to 1.4, more preferably from 0.7 to 1.3, and most preferably from 0.8 to 1.2.

By contriving the photographic material to fall within this range of the ratio of the reflection density, an image of high picture quality can be obtained in surface exposure and scanning exposure.

The reflection density in the present invention is determined by a reflection densitometer generally used in the industry and is defined as follows. However, a sample should be lined with a standard reflector to prevent measuring error due to light to transmit through the sample.

$$\text{Reflection density}=\log_{10}(F_0/F)$$

$F_0$: Reflected beam of light of the standard white reflector

F: Reflected beam of light of the sample

Further, it is particularly preferred for the same reason as described above that the ratio of the reflection density at a wavelength having a maximum intensity of a coherent light for sensitizing the silver halide emulsion in the silver halide emulsion layer containing a cyan dye-forming coupler, to the reflection density of the photographic material at 700 nm is from 0.6 to 1.4, and the ratio of the reflection density at a wavelength having a maximum intensity of a coherent light for sensitizing the silver halide emulsion in the silver halide emulsion layer containing a yellow dye-forming coupler, to the reflection density of the photographic material at 480 nm is from 0.6 to 1.4.

For realizing the above reflection density, it is preferred to include the dyes decolorable by photographic processing (above all, oxonol dyes) disclosed in EP-A-337490, pages 27 to 76 in hydrophilic colloid layers.

Conventionally known photographic substances and additives can be used in a silver halide photographic material according to the present invention.

For example, a transmitting type support and a reflective type support can be used as a photographic support in the present invention. As a transmitting type support, a transparent film such as a cellulose nitrate film and polyethylene terephthalate, and polyester of 2,6-naphthalene-dicarboxylic acid (NDCA) and ethylene glycol (EG), polyester of NDCA, terephthalic acid and EG having an information recording layer such as a magnetic recording layer are preferably used. A reflective type support is preferably used for the object of the present invention, in particular, a reflective support, which is laminated with a plurality of polyethylene layers and polyester layers and at least one of such water resistant resin layers (laminate layers) contains a white pigment, e.g., titanium oxide, is preferred.

Further, a brightening agent is preferably contained in the above water resistant resin layers. A brightening agent may be dispersed in a hydrophilic colloid layer of a photographic material. Preferred brightening agents are benzoxazole based, coumalin based, and pyrazoline based brightening agents, and more preferred are benzoxazolyl-naphthalene based and benzoxazolylstilbene based brightening agents. The addition amount is not particularly limited but is preferably from 1 to 100 mg/m$^2$. The mixing ratio when they are added to a water resistant resin is preferably from 0.0005 to 3 wt %, more preferably from 0.001 to 0.5 wt %, to the resin.

A transmitting type support and the above-described reflective type support which are coated with a hydrophilic colloid layer containing a white pigment may also be used as a reflective type support.

A reflective type support having a metal surface of mirror reflectivity or diffuse reflection (reflectivity) of second type may also be used.

Preferred examples of reflective type supports, silver halide emulsions, storage stabilizers and antifoggants for silver halide emulsions, spectral sensitization methods (spectral sensitizers), cyan, magenta and yellow couplers and emulsifying dispersion methods thereof, color image storage improvers (antistaining agents and discoloration inhibitors), dyes (coloring layers), kinds of gelatins, layer structures and pH of coated films of photographic materials are disclosed in the patents described in the following Tables 1 and 2, and they are preferably applied to the present invention.

TABLE 1

| Photographic Constitutional Element | JP-A-7-104448 | JP-A-7-7775 | JP-A-7-301895 |
|---|---|---|---|
| Reflective type support | l. 12, column 7 to l. 19, column 12 | l. 43, column 35 to l. 1, column 44 | l. 40, column 5 to l. 26, column 9 |
| Storage stabilizer and antifoggant | l. 9, column 75 to l. 18, the same column | l. 20, column 47 to l. 29 the same column | l. 11, column 18 to l. 37, column 31 (in particular, mercapto heterocyclic compound) |
| Spectral sensitizing method (spectral sensitizer) | l. 19, column 75 to l. 45, column 76 | l. 30, column 47 to l. 6, column 49 | l. 21, column 81 to l. 48, column 82 |
| Cyan coupler | l. 20, column 12 to l. 49, column 39 | l. 50, column 62 to l. 16, the same column | l. 49, column 88 to l. 16, column 89 |
| Yellow coupler | l. 40, column 87 to l. 3, column 88 | l. 17, column 63 to l. 30, the same column | l. 17, column 89 to l. 30, the same column |
| Magenta coupler | l. 4, column 88 to l. 18, the same column | l. 3, column 63 to l. 11, column 64 | l. 34, column 31 to l. 44, column 77; l. 32, column 89 to l. 46, the same column |

TABLE 2

| Photographic Constitutional Element | JP-A-7-104448 | JP-A-7-7775 | JP-A-7-301895 |
|---|---|---|---|
| Emulsifying dispersion method of coupler | l. 3, column 71 to l. 11, column 72 | l. 36, column 61 to l. 49, the same column | l. 35, column 87 to l. 48, the same column |
| Color image storage improver (antistaining agent) | l. 50, column 39 to l. 9, column 70 | l. 50, column 61 to l. 49, column 62 | l. 49, column 87 to l. 48, column 88 |
| Discoloration inhibitor | l. 10, column 70 to l. 2, column 71 | | |
| Dye (coloring layer) | l. 42, column 77 to l. 41, column 78 | l. 14, column 7 to l. 42, column 19; l. 3, column 50 to l. 14, column 51 | l. 27, column 9 to l. 10, column 18 |
| Kind of gelatin | l. 42, column 78 to l. 48, the same column | l. 15, column 51 to l. 20, the same column | l. 13, column 83 to l. 19, the same column |
| Layer structure of photographic material | l. 11, column 39 to l. 26, the same column | l. 2, column 44 to l. 35, the same column | l. 38, column 31 to l. 33, column 32 |
| pH of coated film of photographic material | l. 12, column 72 to l. 28, the same column | | |
| Scanning exposure | l. 6, column 76 to l. 41, column 77 | l. 7, column 49 to l. 2, column 50 | l. 49, column 82 to l. 12, column 83 |
| Preservative in developing solution | l. 19, column 88 to l. 22, column 89 | | |

In addition to the above, cyan, magenta and yellow couplers disclosed in JP-A-62-215272, page 91, right upper column, line 4 to page 121, left upper column, line 6, JP-A-2-33144, page 3, right upper column, line 14 to page 18, left upper column, the last line, JP-A-2-33144, page 30, right upper column, line 6 to page 35, right lower column, line 11, and EP-A-355660, page 4, lines 15 to 27, page 5, line 30 to page 28, the last line, page 45, lines 29 to 31, and page 47, line 23 to page 63, line 50 can also be used in the present invention.

As cyan couplers, pyrrolotriazole cyan couplers disclosed in JP-A-5-313324, JP-A-5-313325, JP-A-6-347960 and JP-A-8-110623 are particularly preferred.

Fungicides and biocides disclosed in JP-A-63-271247 are useful for the present invention.

The photographic material of the present invention can be used, in addition to the printing system using a general negative printer, in a digital scanning exposure system using monochromatic high density light, such as a gas laser, a light emitting diode, a semiconductor laser, a second harmonic generation light source (SHG) comprising a combination of nonlinear optical crystal with a semiconductor laser or a solid state laser using a semiconductor laser as an excitation light source. For obtaining a compact and inexpensive system, it is preferred to use a semiconductor laser, or a second harmonic generation light source (SHG) comprising a combination of nonlinear optical crystal with a semiconductor laser or a solid state laser. In particular, for designing a compact and inexpensive apparatus having a longer duration of life and high stability, it is preferred to use a semiconductor laser, at least one of exposure light sources should be a semiconductor laser.

When such a scanning exposure light source is used, the spectral sensitivity maximum wavelength of the photographic material of the present invention can be set arbitrarily according to the wavelength of the scanning exposure light source to be used. As oscillation wavelength of a laser can be made half using an SHG light source comprising a combination of nonlinear optical crystal with a solid state laser using a semiconductor laser as an excitation light source or a semiconductor laser, blue light and green light can be obtained. Accordingly, it is possible to have the spectral sensitivity maximum of a photographic material in normal three regions of blue, green and red.

The exposure time in such a scanning exposure is defined as the time necessary to expose the size of the picture element with the density of this picture element being 400 dpi, and preferred exposure time is $10^{-4}$ sec or less and more preferably $10^{-6}$ sec or less.

Preferred scanning exposure systems which can be applied to the present invention are disclosed in detail in the patents described in the above table.

For processing the photographic material according to the present invention, processing substances and processing methods disclosed in JP-A-2-207250, page 26, right lower column, line 1 to page 34, right upper column, line 9 and JP-A-4-97355, page 5, left upper column, line 17 to page 18, right lower column, line 20 can be preferably used. Further, as preservatives for use in these developing solutions, compounds disclosed in the patents described in the above table can preferably be used.

The present invention is described in detail with reference to the examples, but it should not be construed as being limited thereto.

EXAMPLE 1

Preparation of Emulsion A

After 32.0 g of lime-processed gelatin was added to 1,000 ml of a distilled water and dissolved at 40° C., pH was adjusted to 3.8 with sulfuric acid, then 5.5 g of sodium chloride and 0.02 g of N,N'-dimethylimidazolidine-2-thione were added and the temperature was raised to 52.5° C. Subsequently, a solution of 5.0 g of silver nitrate dissolved in 140 ml of a distilled water and a solution of 1.7 g of sodium chloride dissolved in 140 ml of a distilled water were added to the above solution and mixed with vigorously stirring while maintaining the temperature at 52.5° C. Further, a solution of 120 g of silver nitrate dissolved in 320 ml of a distilled water and a solution of 41.3 g of sodium chloride dissolved in 320 ml of a distilled water were added thereto and mixed with vigorously stirring while maintaining the temperature at 52.5° C. An aqueous solution containing $5\times10^{-5}$ mol of $K_3Fe(CN)_6$ per mol of the silver halide and $1\times10^{-8}$ mol of $K_2IrCl_6$ per mol of the silver halide was added thereto after 80% of the entire amount of the silver nitrate was added until the completion of the addition of the silver nitrate at the feeding rate with maintaining the constant ratio with the addition concentration of the silver nitrate. After desalting and washing with water were carried out at 40° C., 76.0 g of lime-processed gelatin was added thereto, and pAg and pH were adjusted to 7.9 and 6.2, respectively, using sodium chloride and sodium hydroxide. The temperature was raised to 50° C, then blue-sensitive sensitizing dyes A and B shown below were added in an amount of, respectively, $2.0\times10^{-4}$ mol per mol of the silver halide, and gold sulfur sensitization was carried out using triethylthiourea and chloroauric acid. Further, during chemical ripening, a silver bromide rich area was formed on the surface of silver chloride grain by the addition of silver bromide fine grained emulsion having a grain size of 0.05 μm containing $K_3IrCl_6$, and $1\times10^{-6}$ mol per mol of the silver halide of $K_2IrCl_6$ was contained in the silver bromide rich area. The thus-obtained silver halide emulsion (silver chloride content: 99.5 mol %) was named Emulsion A.

With respect to Emulsion A, the form of the grains, the grain size and the variation coefficient were obtained from electron microphotographs. The grain size was the average grain size of the diameters of circles having the same areas as the projected areas of grains, and the variation coefficient was the value obtained by dividing the standard deviation of the grains by the average grain size. Emulsion A was a monodisperse cubic grain emulsion having the grain size of 0.46 μm and the variation coefficient of 0.09.

Sensitizing Dyes for Blue-Sensitive Emulsion Layer

Sensitizing Dye A

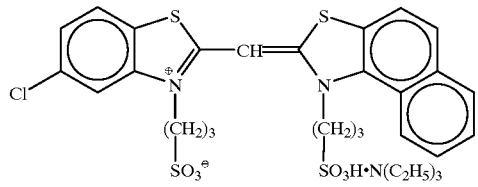

Sensitizing Dye B

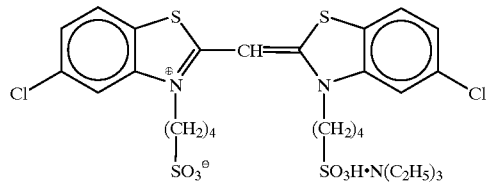

(each in an amount of $2.0\times10^{-4}$ mol per mol of the silver halide)

Emulsion B was prepared in the same manner as the preparation of Emulsion A except that spectral sensitization was conducted using the following green-sensitive spectral sensitizing dyes C and D, and Emulsion C was prepared in the same manner except that spectral sensitization was conducted using the following red-sensitive spectral sensitizing dye.

Sensitizing Dyes for Green-Sensitive Emulsion Layer

Sensitizing Dye C

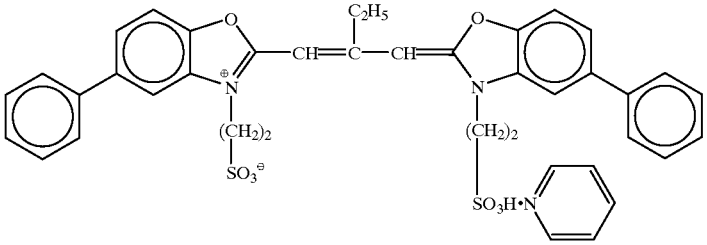

(in an amount of $4.0\times10^{-4}$ mol per mol of the silver halide)

Sensitizing Dye D

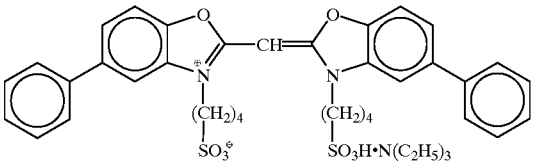

(in an amount of $7.0\times10^{-5}$ mol per mol of the silver halide)

Sensitizing Dye for Red-Sensitive Emulsion Layer

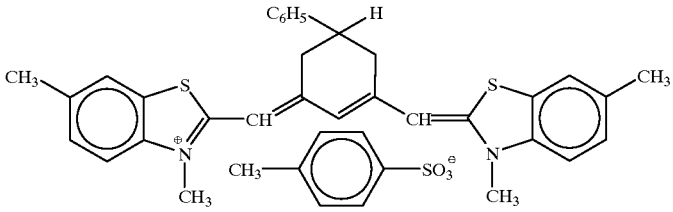

(in an amount of $0.9\times10^{-4}$ mol per mol of the silver halide)

Further, the following compound was added to the red-sensitive silver halide emulsion in an amount of $2.6\times10^{-3}$ mol per mol of the silver halide.

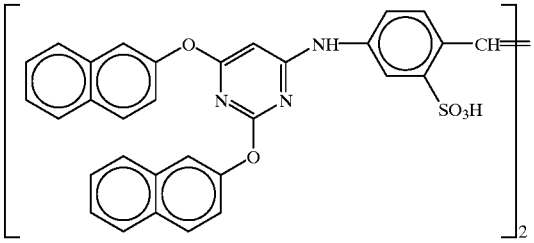

Moreover, the following dyes (the numeral in the parenthesis represents the coating amount) were added to the fourth layer (a color mixing preventing layer) for irradiation prevention. However, as these dyes are water-soluble, they diffuse entirely in hydrophilic photographic constitutional layers after coating.

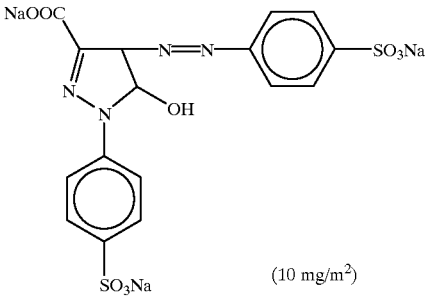

(10 mg/m$^2$)

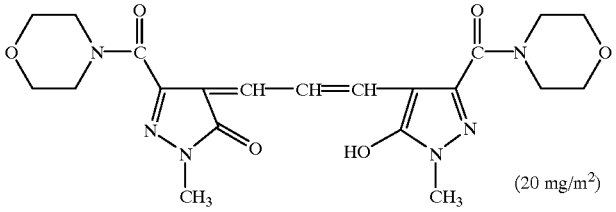

(20 mg/m$^2$)

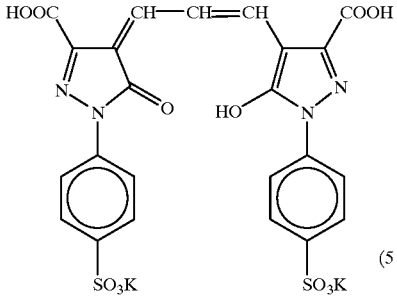

(5 mg/m$^2$)

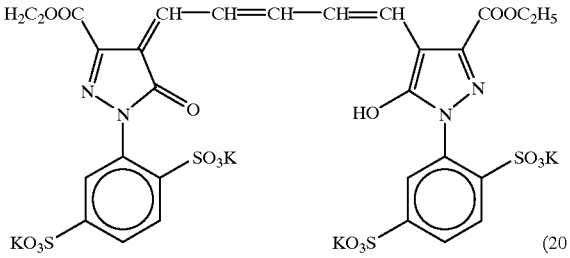

(20 mg/m$^2$)

and

-continued

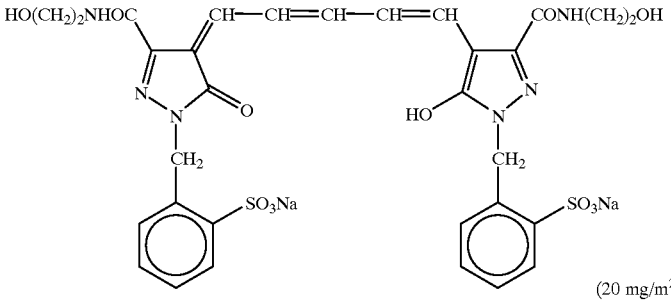

(20 mg/m$^2$)

Further, Cpd-12 to Cpd-15 were added to each photographic constitutional layer as preservatives so that the total amount of each compound became 10 mg/m$^2$, 6.0 mg/m$^2$, 5.0 mg/m$^2$ and 16.0 mg/m$^2$, respectively.

Layer Composition

The composition of each layer is described below. The numeral represents the coating amount (g/m$^2$). The numeral for silver halide emulsion represents the coating amount in terms of silver.

Support

Polyethylene-Laminated Paper (a white pigment (TiO2) and a blue dye (ultramarine) were added to the polyethylene of the first layer side).

| | |
|---|---|
| First Layer (blue-sensitive emulsion layer) | |
| Silver Chloride Emulsion A described above | 0.24 |
| Gelatin | 1.33 |
| Yellow Coupler (ExY) | 0.61 |
| Color Image Stabilizer (Cpd-1) | 0.08 |
| Color Image Stabilizer (Cpd-2) | 0.04 |
| Color Image Stabilizer (Cpd-3) | 0.08 |
| Solvent (Solv-1) | 0.22 |
| Second Layer (color mixture preventing layer) | |
| Gelatin | 1.09 |
| Color Mixing Preventive (Cpd-4) | 0.11 |
| Color Image Stabilizer (Cpd-16) | 0.15 |
| Solvent (Solv-1) | 0.10 |
| Solvent (Solv-2) | 0.15 |
| Solvent (Solv-3) | 0.12 |
| Solvent (Solv-7) | 0.01 |
| Third Layer (green-sensitive emulsion layer) | |
| Silver Chloride Emulsion B described above | 0.11 |
| Gelatin | 1.19 |
| Magenta Coupler (ExM) | 0.12 |
| Ultraviolet Absorber (UV-1) | 0.12 |
| Color Image Stabilizer (Cpd-2) | 0.01 |
| Color Image Stabilizer (Cpd-4) | 0.01 |
| Color Image Stabilizer (Cpd-5) | 0.01 |
| Color Image Stabilizer (Cpd-6) | 0.01 |
| Color Image Stabilizer (Cpd-8) | 0.01 |
| Color Image Stabilizer (Cpd-16) | 0.08 |
| Color Image Stabilizer (Cpd-18) | 0.0001 |
| Solvent (Solv-4) | 0.20 |
| Solvent (Solv-5) | 0.11 |
| Solvent (Solv-9) | 0.19 |
| Fourth Layer (color mixture or eventing layer) | |
| Gelatin | 0.77 |
| Color Mixing Preventive (Cpd-4) | 0.08 |
| Color Image Stabilizer (Cpd-16) | 0.11 |
| Solvent (Solv-1) | 0.07 |
| Solvent (Solv-2) | 0.11 |
| Solvent (Solv-3) | 0.09 |
| Solvent (Solv-7) | 0.01 |

-continued

| | |
|---|---|
| Fifth Layer (red-sensitive emulsion layer) | |
| Silver Chloride Emulsion C described above | 0.11 |
| Gelatin | 0.80 |
| Cyan Coupler (ExC) | 0.28 |
| Ultraviolet Absorber (UV-3) | 0.19 |
| Color Image Stabilizer (Cpd-1) | 0.24 |
| Color Image Stabilizer (Cpd-6) | 0.01 |
| Color Image Stabilizer (Cpd-8) | 0.01 |
| Color Image Stabilizer (Cpd-9) | 0.04 |
| Color Image Stabilizer (Cpd-10) | 0.01 |
| Solvent (Solv-1) | 0.01 |
| Solvent (Solv-6) | 0.21 |
| Sixth Layer (ultraviolet absorbing layer) | |
| Gelatin | 0.64 |
| Ultraviolet Absorber (UV-2) | 0.39 |
| Color Image Stabilizer (Cpd-5) | 0.05 |
| Color Image Stabilizer (Cpd-17) | 0.05 |
| Solvent (Solv-8) | 0.05 |
| Seventh Layer (protective layer) | |
| Gelatin | 1.01 |
| Acryl-Modified Copolymer of Polyvinyl Alcohol (modification degree: 17%) | 0.04 |
| Liquid Paraffin | 0.02 |
| Surfactant (Cpd-11) | 0.01 |

(ExY) Yellow Coupler
1/1 mixture by mol ratio of
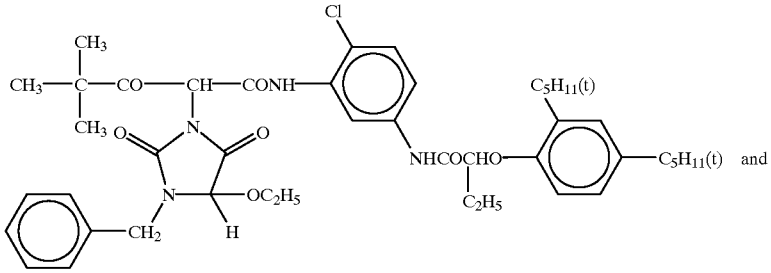
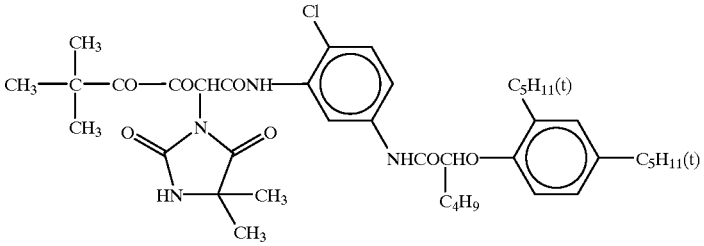
(ExM) Magenta Coupler
1/1 mixture by mol ratio of
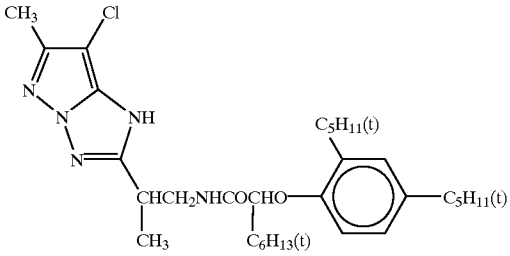
and
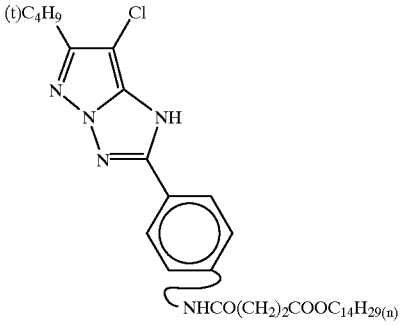
(ExC) Cyan Coupler
25/75 mixture by mol ratio of
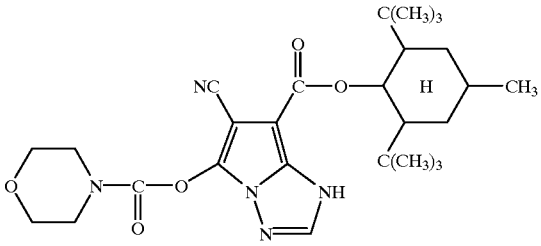
and
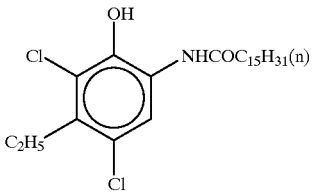
(Cpd-1) Color Image Stabilizer
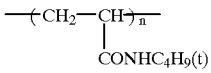
number average molecular weight: 60,000
(Cpd-2) Color Image Stabilizer
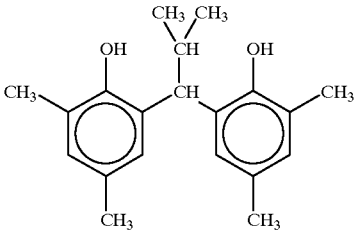

-continued
(Cpd-3) Color Image Stabilizer
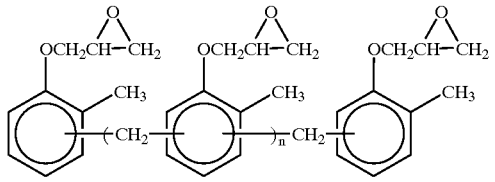
n = 7–8 (average value)
(Cdp-4) Color Mixing Preventative
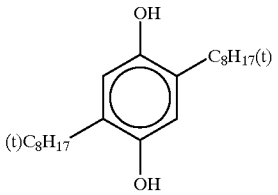
(Cpd-5) Color Image Stabilizer
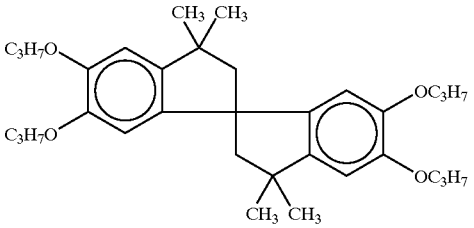
(Cpd-6) Color Image Stabilizer
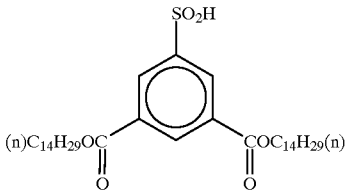
(Cpd-8) Color Image Stabilizer
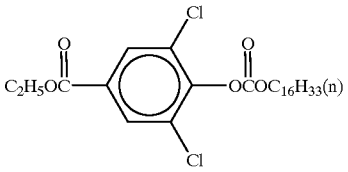
(Cpd-9) Color Image Stabilizer
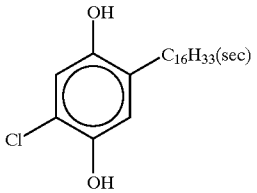
(Cpd-10) Color Image Stabilizer
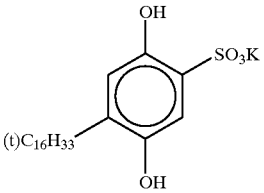
(Cpd-11) Surfactant
7/3 mixture by weight ratio of
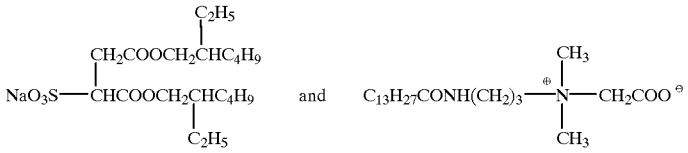
(Cpd-12) Preservative
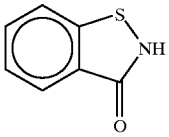
(Cpd-13) Preservative
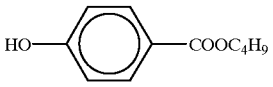

-continued
(Cpd-14) Preservative
1/1/1/1 mixture of a/b/c/d
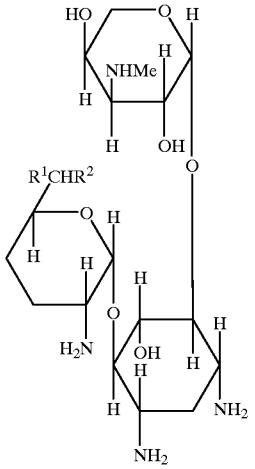
| | $R^1$ | $R^2$ |
|---|---|---|
| a | —Me | —NHMe |
| b | —Me | —$NH_2$ |
| c | —H | —$NH_2$ |
| d | —H | —NHMe |
(Cpd-15) Preservative
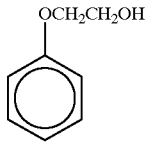
(Cpd-16)
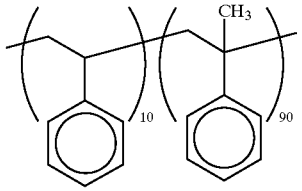
number average molecular weight: 590
weight % of aromatic ring: 65%
(Cpd-17)
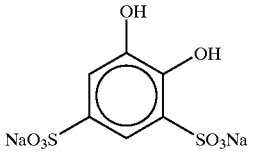
(Cpd-18)
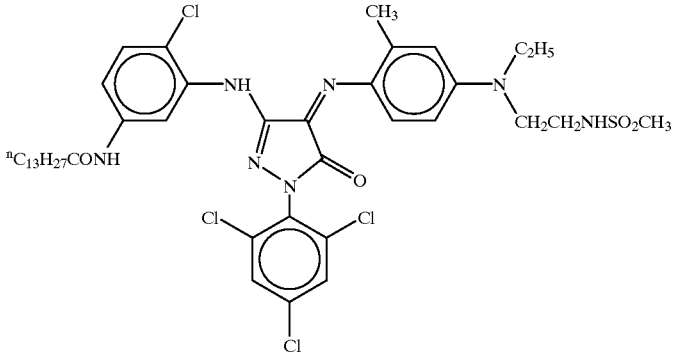
(UV-1) Ultraviolet Absorber
1/3/4 mixture by weight ratio of (1)/(2)/(3)
(1)
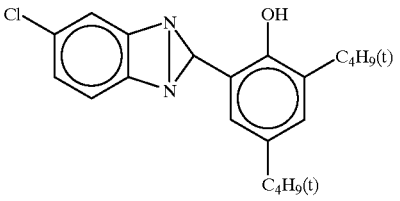
(2)
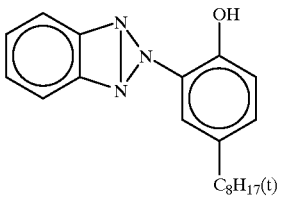
and
(3)
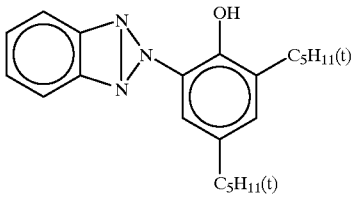

-continued
(UV-2) Ultraviolet Absorber
1/2/2/3/1 mixture by weight ratio of (1)/(2)/(3)/(4)/(5)
(1)
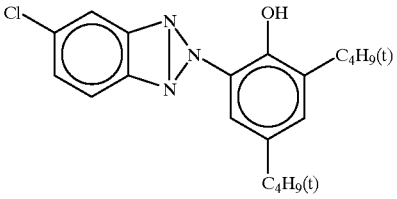
(2)
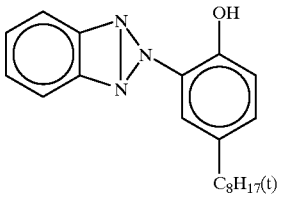
(3)
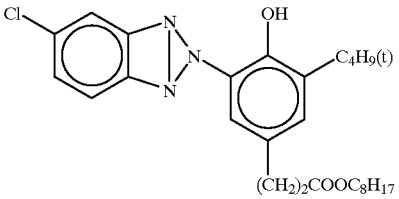
(4)
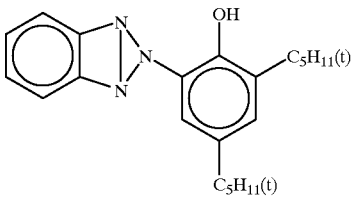
and
(5)
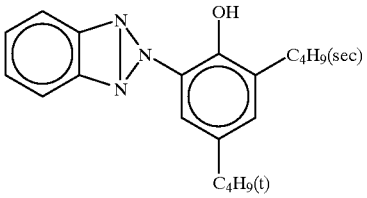
(UV-3) UV Absorbing Agent
1/3/2/1 mixture by weight ratio of (1)/(2)/(3)/(4)
(1)
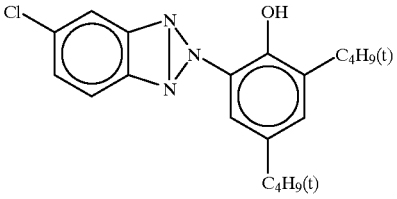
(2)
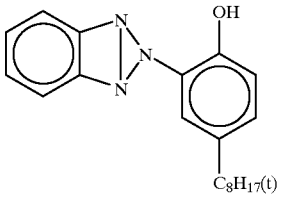
(3)
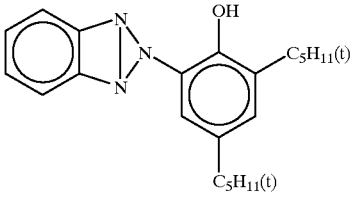
and
(4)
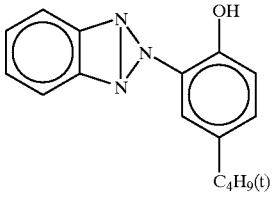
(Solv-1) Solvent
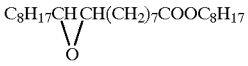
(Solv-2) Solvent
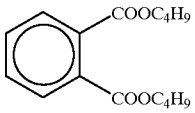
(Solv-3) Solvent
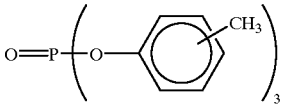
(Solv-4) Solvent
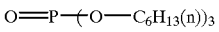

-continued (Solv-5) Solvent

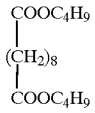

(Solv-6) Solvent

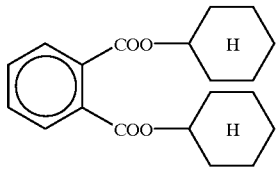

(Solv-7) Solvent

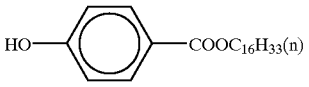

(Solv-8) Solvent

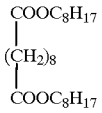

(Solv-9) Solvent

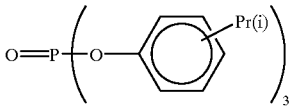

Sample No. 101 was thus prepared.

With respect to Sample No. 101, the ratio of the point gamma by exposure time of $10^{-4}$ seconds to the point gamma by exposure time of 0.1 seconds was obtained according to the above-described method.

Further, for evaluating the quality of a letter by scanning exposure, a black letter of [東] (a Chinese character) varied in sizes were imaged using the following visible light beam and a blur of the letter was evaluated functionally. However, at that time, the maximum density in the letter was adjusted to become the foregoing density.

Three types of laser beams were used as light sources, that is, the wavelength of YAG solid state laser (oscillation wavelength: 946 nm) using a semiconductor laser GaAlAs (oscillation wavelength: 808.5 nm) as an excitation light source converted with SHG crystal of $KNbO_3$ to 473 nm, the wavelength of $YVO_4$ solid state laser (oscillation wavelength: 1,064 nm) using a semiconductor laser GaAlAs (oscillation wavelength: 808.7 nm) as an excitation light source converted with SHG crystal of KTP to 532 nm, and AlGaInP (oscillation wavelength: 688 nm, manufactured by Toshiba Co., Ltd.). Each of laser beams of three colors transferred vertically to scanning direction by a polygonal mirror and could successively scanning expose a color photographic paper. For restraining the fluctuation of light amount due to changes of temperature, the temperature of semiconductor laser was maintained constant using Peltier element.

Exposure amount was controlled using an external modulator and exposure was conducted.

At that time, scanning pitch was 42.3 $\mu$m (600 dpi), and an average exposure time per picture element was $1.7\times10^{-7}$ seconds.

For the evaluation of the quality of the letter by surface exposure, the letter [東] written on a lith film was closely contacted with the sample and exposed. The exposure time was 0.1 seconds and the maximum density in the letter was adjusted to become the foregoing density.

Further, emulsions shown in Table 3 were prepared by changing the amount of metal ion doping and the addition amount of the chemical sensitizer in the preparation of each silver halide emulsion of Sample No. 101, and Sample Nos. 102 to 109 were prepared by replacing the emulsions in Sample No. 101 with these emulsions. Samples having printed the same letter were produced with respect to these samples.

Evaluation of the quality of the letter of these samples was conducted by taking the average value of functional evaluation (from point 1 to point 10) by fifty persons. Accordingly, it means that the higher the value, the higher is the quality.

The results obtained are shown in Table 3. As is apparent from the results in Table 3, excellent letter qualities can be obtained only in the samples having the ratio of point gamma of the present invention by both surface exposure using a lith film and scanning exposure.

TABLE 3

| Sample No. | Point Gamma by Exposure Time of $10^{-4}$ Sec./Point Gamma by Exposure Time of 0.1 Sec. | Quality of* Letter by Scanning Exposure | Quality of* Letter by Surface Exposure | Remarks |
|---|---|---|---|---|
| 101 | 0.9 | 9.3 | 9.4 | Invention |
| 102 | 0.4 | 4.0 | 9.2 | Comparison |
| 103 | 0.6 | 5.1 | 9.2 | Comparison |
| 104 | 0.7 | 8.2 | 9.4 | Invention |
| 105 | 1.0 | 9.5 | 9.8 | Invention |
| 106 | 1.1 | 9.5 | 9.5 | Invention |
| 107 | 1.3 | 9.4 | 8.3 | Invention |
| 108 | 1.4 | 9.2 | 5.0 | Comparison |
| 109 | 1.6 | 9.2 | 4.0 | Comparison |

Average value was taken on the basis of 10 points by 50 persons.

EXAMPLE 2

The addition amounts of the dyes for irradiation prevention in Sample No. 104 were changed to make the reflection density of the photographic material at 550 nm constant, and the ratio of the reflection density at a wavelength having a maximum intensity (532 nm in this example) of the coherent light, to which the silver halide emulsion in the silver halide emulsion layer containing a magenta dye-forming coupler was sensitized, to the reflection density of the photographic material at 550 nm was changed as shown in the following Table 4. Sample Nos. 201 to 203 were thus prepared.

The samples obtained were functionally evaluated as in Example 1, provided that the color of the letter was magenta color.

The results obtained are shown in Table 4 below. As can be seen from the results in Table 4, more excellent letter qualities can be obtained by scanning exposure when the ratio of the reflection density at a wavelength having a maximum intensity of the coherent light, to which the silver halide emulsion in the silver halide emulsion layer containing a magenta dye-forming coupler is sensitized, to the reflection density of the photographic material at 550 nm is 0.6 or more.

TABLE 4

| Sample No. | Reflection Density at 532 nm/ Reflection Density at 550 nm | Quality of Letter by Scanning Exposure | Quality of Letter by Surface Exposure | Remarks |
|---|---|---|---|---|
| 104 | 0.7 | 8.2 | 9.4 | Invention |
| 201 | 0.4 | 8.2 | 8.0 | Invention |
| 202 | 0.6 | 8.2 | 9.2 | Invention |
| 203 | 1.0 | 8.2 | 9.5 | Invention |

The addition amounts of the dyes for irradiation prevention in Sample No. 203 were changed to make th he reflection density of the photographic material at 700 nm constant, and the ratio of the reflection density at a wavelength having a maximum intensity (688 nm in this example) of the coherent light, to which the silver halide emulsion in the silver halide emulsion layer containing a cyan dye-forming coupler was sensitized, to the reflection density of the photographic material at 700 nm was changed, and further the reflection density of the photographic material at 480 nm was made constant, and the ratio of the reflection density at a wavelength having a maximum intensity (473 nm in this example) of the coherent light, to which the silver halide emulsion in the silver halide emulsion layer containing a yellow dye-forming coupler was sensitized, to the reflection density of the photographic material at 480 nm was changed, as shown in the following Table 5. Sample Nos. 301 to 305 were thus prepared.

The same functional evaluation of the black letter as in Example 1 was conducted with respect to these samples.

The results obtained are shown in Table 5 below. As is apparent from the results in Table 5, excellent letter qualities without blurring of color in the periphery of the letter can be obtained by surface exposure and scanning exposure when the ratios of the reflection densities of the photographic material at wavelengths at which the silver halide emulsions in the silver halide emulsion layers containing a cyan dye-forming coupler and a yellow dye-forming coupler are exposed are within the preferred range of the present invention.

TABLE 5

| Sample No. | Reflection Density at 532 nm/ Reflection Density at 550 nm | Reflection Density at 688 nm/ Reflection Density at 700 nm | Reflection Density at 473 nm/ Reflection Density at 480 nm | Quality of Letter by Scanning Exposure | Quality of Letter by Surface Exposure | Remarks |
|---|---|---|---|---|---|---|
| 301 | 1.0 | 1.2 | 1.0 | 9.8 | 9.8 | Invention |
| 302 | 1.0 | 1.0 | 1.0 | 9.8 | 9.8 | Invention |
| 303 | 1.0 | 0.7 | 0.7 | 9.5 | 9.5 | Invention |
| 304 | 1.0 | 0.6 | 0.6 | 8.5 | 8.5 | Invention |
| 305 | 1.0 | 0.5 | 0.5 | 8.0 | 8.0 | Invention |

EXAMPLE 4

The same evaluation was conducted by changing the support used in Examples 1 to 3 to a support having incorporated the following brightening agents into the polyethylene of the first layer side.

When the support containing the brightening agents is used, the superimposed white letter image is clear and the effect of the present invention is more conspicuous.

Brightening Agent II

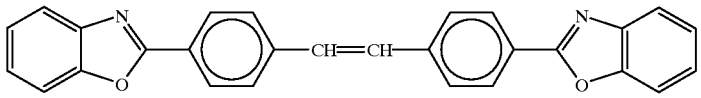

Brightening Agent I

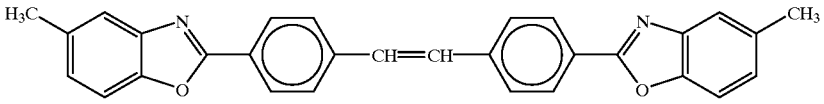

II/I=20/80 (ratio by weight)

content: 15 mg/m$^2$ the ratio based on polyethylene: 0.05 wt %

A silver halide color photographic material which provides excellent letter quality by either surface exposure or scanning exposure can be obtained according to the present invention.

While the invention has been described in detail and with reference to specific examples thereof, it will be apparent to one skilled in the art that various changes and modifications can be made therein without departing from the spirit and scope thereof.

What is claimed is:

1. A silver halide color photographic material for a scanning exposure system, which comprises a support having provided thereon at least one blue-sensitive silver halide emulsion layer containing a yellow dye-forming coupler, at least one green-sensitive silver halide emulsion layer containing a magenta dye-forming coupler, and at least one red-sensitive silver halide emulsion layer containing a cyan-dye forming coupler, wherein at least one of said at least one emulsion layers (i) contains silver chloride or silver chlorobromide emulsion grains having a silver chloride content of 95 mol % or more and substantially free of silver iodide, and (ii) has a ratio of point gamma I to point gamma II of 0.7 to 1.3, wherein when points giving densities of 1.0 and 1.5 on a characteristic curve: D-logE curve, where D represents density and E represents an exposure amount, obtained by an exposure time of $10^{-4}$ second are joined by a straight line, point gamma I is a point gamma on the characteristic curve, at a density which is 1.5 or more and which satisfies the condition where the value of logE on the characteristic curve is larger by 0.05 than that on the straight line at the same density, and wherein when points giving densities of 1.0 and 1.5 on a characteristic curve: D-logE curve, where D represents density and E represents an exposure amount, obtained by an exposure time of 0.1 second are joined by a straight line, point gamma II is a point gamma on the characteristic curve, at a density which is 1.5 or more and which satisfies the condition where the value of logE on the characteristic curve is larger by 0.05 than that on the straight line at the same density.

2. The silver halide color photographic material as claimed in claim 1, wherein the ratio of the reflection density at a wavelength having a maximum intensity of a coherent light for sensitizing the silver halide emulsion in the silver halide emulsion layer containing a magenta dye-forming coupler, to the reflection density of the photographic material at 550 nm is 0.6 or more.

3. The silver halide color photographic material as claimed in claim 1, wherein all of said silver halide emulsion layer containing a yellow dye-forming coupler, said silver halide emulsion layer containing a magenta dye-forming coupler, and said silver halide emulsion layer containing a cyan-dye forming coupler contain silver chloride or silver chlorobromide emulsion grains having a silver chloride content of 95 mol % or more and substantially free of silver iodide.

4. The silver halide color photographic material as claimed in claim 2, wherein the ratio of the reflection density at a wavelength having a maximum intensity of a coherent light for sensitizing the silver halide emulsion in the silver halide emulsion layer containing a cyan dye-forming coupler, to the reflection density of the photographic material at 700 nm is from 0.6 to 1.4, and the ratio of the reflection density at a wavelength having a maximum intensity of a coherent light for sensitizing the silver halide emulsion in the silver halide emulsion layer containing a yellow dye-forming coupler, to the reflection density of the photographic material at 480 nm is from 0.6 to 1.4.

5. The silver halide color photographic material as claimed in claim 1, wherein said at least one of said at least one emulsion layers having a ratio of point gamma I to point gamma II of 0.7 to 1.3 has silver halide grains containing ions or complex ions of metals belonging to group VIII of the Periodic Table selected from the group consisting of osmium, iridium, rhodium, platinum, ruthenium, palladium, cobalt, nickel and iron, alone or in combination.

6. The silver halide color photographic material as claimed in claim 5, wherein said metals are used in an amount of $10^{-9}$ to $10^{-2}$ mol per mol of silver halide.

7. The silver halide color photographic material as claimed in claim 1, wherein said at least one of said at least one emulsion layers having a ratio of point gamma I to point gamma II of 0.7 to 1.3 has silver halide grains containing iridium ions and iron ions in combination.

8. The silver halide color photographic material as claimed in claim 5, wherein at least 50 mol % of the total content of the metal ions belonging to group VIII of the Periodic Table is contained in the surface layer which occupy 45% or less of the silver halide grain volume.

9. The silver halide color photographic material as claimed in claim 5, wherein the silver halide grains containing ions or complex ions of metals belonging to group VIII of the Periodic Table selected from the group consisting of osmium, iridium, rhodium, platinum, ruthenium, palladium, cobalt, nickel and iron, alone or in combination are sensitized with gold.

10. The silver halide color photographic material as claimed in claim 1, wherein the silver halide emulsion in said at least one of said at least one emulsion layers has a silver bromide rich phase.

11. The silver halide color photographic material as claimed in claim 10, wherein the silver bromide rich phase is formed by mixing and silver halide fine grains having a smaller average grain size and a higher silver bromide content than the host grains, and then ripening, and an iridium salt is added to the silver halide fine grains in advance of the mixing.

12. The silver halide color photographic material as claimed in claim 5, wherein the ions or complex ions of metals belonging to Group VIII of the Periodic Table are iridium ions.

13. The silver halide color photographic material as claimed in claim 1, wherein the support is a reflective support having provided thereon at least one water resistant resin layer containing a white pigment and a brightening agent.

14. The silver halide color photographic material as claimed in claim 1, further comprising an oxonol dye decolorable by photographic processing, wherein the ratio of the reflection density at a wavelength having a maximum intensity of a coherent light for sensitizing the silver halide emulsion in the silver halide emulsion layer containing a magenta dye-forming coupler, to the reflection density of the photographic material at 550 nm is 0.6 or more.

15. A method for forming a color image, which comprises the steps of exposing a silver halide color photographic material for a scanning exposure system to a scanning exposure for an exposure time of not more than $10^{-4}$ second and development treating the exposed photographic material, wherein said silver halide color photographic material comprises a support having provided thereon at least one blue-sensitive silver halide emulsion layer containing a yellow dye-forming coupler, at least one green-sensitive silver halide emulsion layer containing a magenta dye-forming coupler, and at least one red-sensitive silver halide emulsion layer containing a cyan-dye forming coupler, wherein at least one of said at least one emulsion layers (i) contains silver chloride or silver chlorobromide emulsion grains having a silver chloride content of 95% mol % or more and substantially free of silver iodide, and (ii) has a ratio of point gamma I to point gamma an of 0.7 to 1.3, wherein when points giving densities of 1.0 and 1.5 on a characteristic curve: D-logE curve, where D represents density and E represents an exposure amount, obtained by an exposure time of $10^{-4}$ second are joined by a straight line, point gamma I is a point gamma on the characteristic curve, at a density which is 1.5 or more and which satisfies the condition where the value of logE on the characteristic curve is larger by 0.05 than that on the straight line at the same density, and wherein when points giving densities of 1.0 and 1.5 on a characteristic curve: D-logE curve, where D represents density and E represents an exposure amount, obtained by an exposure time of 0.1 second are joined by a straight line, point gamma II is a point gamma on the characteristic curve, at a density which is 1.5 or more and which satisfies the condition where the value of logE on the characteristic curve is larger by 0.05 than that on the straight line at the same density.

16. The method of forming a color image as claimed in claim 15, wherein the exposure time of the scanning exposure is not more than $10^{-6}$ seconds.

17. The method for forming a color image as claimed in claim 15, wherein the scanning exposure is effected by laser beam.

18. The method for forming a color image as claimed in claim 15, wherein the ratio of the reflection density at a wavelength having a maximum intensity of a coherent light for sensitizing the silver halide emulsion in the silver halide emulsion layer containing a magenta dye-forming coupler, to the reflection density of the photographic material at 550 nm is 0.6 or more.

19. The method for forming a color image as claimed in claim 15, wherein all of said silver halide emulsion layer containing a yellow dye-forming coupler, said silver halide emulsion layer containing a magenta dye-forming coupler, and said silver halide emulsion layer containing a cyan-dye forming coupler contain silver chloride or silver chlorobromide emulsion grains having a silver chloride content of 95 mol % or more and substantially free of silver iodide.

20. The method for forming a color image as claimed in claim 15, wherein the ratio of the reflection density at a wavelength having a maximum intensity of a coherent light for sensitizing the silver halide emulsion in the silver halide emulsion layer containing a cyan dye-forming coupler, to the reflection density of the photographic material at 700 nm is from 0.6 to 1.4, and the ratio of the reflection density at a wavelength having a maximum intensity of a coherent light for sensitizing the silver halide emulsion in the silver halide emulsion layer containing a yellow dye-forming coupler, to the reflection density of the photographic material at 480 nm is from 0.6 to 1.4.

21. The method for forming a color image as claimed in claim 15, wherein said at least one of said at least one emulsion layers having a ratio of point gamma I to point gamma II of 0.7 to 1.3 has silver halide grains containing ions or complex ions of metals belonging to Group VIII of the Periodic Table selected from the group consisting of osmium, iridium, rhodium, platinum, ruthenium, palladium, cobalt, nickel and iron, alone or in combination.

22. The method for forming a color image as claimed in claim 21, wherein said metals are used in an amount of $10^{-9}$ to $10^{-2}$ mol per mol of silver halide.

23. The method for forming a color image as claimed in claim 15, wherein said at least one of said at least one emulsion layers having a ratio of point gamma I to point gamma II of 0.7 to 1.3 has silver halide grains containing iridium ions and iron ions in combination.

24. The method for forming a color image as claimed in claim 21, wherein at least 50 mol % of the total content of the metal ions belonging to Group VIII of the Periodic Table is contained in the surface layer which occupy 45% or less of the silver halide grain volume.

25. The method for forming a color image as claimed in claim 21, wherein the silver halide grains containing ions or complex ions of metals belonging to Group VIII of the Periodic Table selected from the group consisting of osmium, iridium, rhodium, platinum, ruthenium, palladium, cobalt, nickel and iron, alone or in combination are sensitized with gold.

26. The method for forming a color image as claimed in claim 15, wherein the silver halide emulsion in said at least one of said at least one emulsion layers has a silver bromide rich phase.

27. The method for forming a color image as claimed in claim 21, wherein the ions or complex ions of metals belonging to Group VIII of the Periodic Table are iridium ions.

28. The method for forming a color image as claimed in claim 26, wherein the silver bromide rich phase is formed by mixing and silver halide fine grains having a smaller average grain size and a higher silver bromide content than the host grains, and then ripening, and an iridium salt is added to the silver halide fine grains in advance of the mixing.

29. The method for forming a color image as claimed in claim 15, wherein said at least one cyan-dye forming coupler is a pyrrolotriazole cyan coupler.

30. The method for forming a color image as claimed in claim 15, wherein the support is a reflective support having provided thereon at least one water resistant resin layer containing a white pigment and a brightening agent.

31. The method for forming a color image as claimed in claim 15, wherein the silver halide color photographic material contains an oxonol dye decolorable by photographic processing, and wherein the ratio of the reflection density at a wavelength having a maximum intensity of a coherent light for sensitizing the silver halide emulsion in the silver halide emulsion layer containing a magenta dye-forming coupler, to the reflection density of the photographic material at 550 nm is 0.6 or more.

* * * * *

UNITED STATES PATENT AND TRADEMARK OFFICE

CERTIFICATE OF CORRECTION

PATENT NO. : 6,043,020

DATED : March 28, 2000

INVENTOR(S) : Shigeaki Ohtani

It is certified that error appears in the above-identified patent and that said Letters Patent is hereby corrected as shown below:

Column 30, line 40, after "mixing" delete "and".

Column 32, line 42, after "mixing" delete "and".

Signed and Sealed this

Twenty-seventh Day of June, 2000

*Attest:*

Q. TODD DICKINSON

*Attesting Officer*

*Director of Patents and Trademarks*